United States Patent [19]

Piucci

[11] 4,214,924

[45] Jul. 29, 1980

[54] METHOD OF IMPROVING SURFACE CHARACTERISTIC OF HEAT-TREATED METAL

[75] Inventor: Joseph A. Piucci, Royersford, Pa.

[73] Assignee: Pennwalt Corporation, Philadelphia, Pa.

[21] Appl. No.: 955,252

[22] Filed: Oct. 27, 1978

[51] Int. Cl.[2] ..... C21D 1/56; C10M 1/22

[52] U.S. Cl. ..... 148/18; 148/20.6; 148/28; 148/29; 252/49.5; 252/52 R

[58] Field of Search ..... 148/12.1, 18, 20.6, 148/28, 29, 22; 252/73, 75, 77, 52 R, 49.5, 172, 105

[56] References Cited

U.S. PATENT DOCUMENTS

| | | | |
|---|---|---|---|
| 2,483,725 | 10/1949 | Flemming et al. | 148/29 |
| 3,280,035 | 10/1966 | Bonner | 252/52 R |
| 3,562,026 | 2/1971 | Massey | 148/18 |
| 3,649,538 | 3/1972 | Hotten | 252/52 R |
| 3,676,348 | 7/1972 | Unick et.al. | 252/52 R |
| 3,855,014 | 12/1974 | Vries et al. | 148/28 |
| 3,907,612 | 9/1975 | Atkiss et al. | 148/12.1 |
| 4,054,534 | 10/1977 | Angelini | 252/172 |

OTHER PUBLICATIONS

McCutcheon's, "Detergents and Emulsifiers", 1969, p. 243.

*Primary Examiner*—L. Dewayne Rutledge
*Assistant Examiner*—Peter K. Skiff

[57] ABSTRACT

The invention provides a method for reducing the incidence of thermal decomposition products of metal-treating compositions on the surface of metal heat-treated in the presence of such compositions. The compositions are modified with certain acetylenic alcohols to improve their clean-burning characteristics; the resulting decrease in residual decomposition product on the metal surface facilitates subsequent processing.

8 Claims, No Drawings

METHOD OF IMPROVING SURFACE CHARACTERISTIC OF HEAT-TREATED METAL

BACKGROUND OF THE INVENTION

This invention relates to metal treatment. In particular, this invention relates to a method for reducing carbonaceous residues on metals processed at high temperatures.

Prior to high-temperature exposure, metals are typically treated with various compositions. For example, rolling oil compositions are employed in the cold reduction of steel, and the steel is only partially cleaned of this oil with mill detergent compositions prior to annealing. Since the mill detergent also typically functions to deposit a rust-preventive film to protect the steel during storage, the mill detergent also is not removed from the steel prior to annealing, and the presence of the carbonaceous residue comprising the thermal decomposition products of the oil and detergent on the steel after anneal interferes with subsequent processing. It is thus highly desirable to reduce such carbonaceous residues to provide the cleanest possible steel surface for post-anneal processing of the steel.

It is accordingly an object of the invention to provide a method for reducing the carbonaceous thermal decomposition product residue of metal-treating compositions on treated metal processed at high temperatures.

It is also an object of the invention to provide a method for reducing the thermal decomposition product residue of rolling oil and mill detergent on annealed steel.

It is an additional object of the invention to provide a method for improving adherence of finish or prefinish coatings, such as phosphate coatings, to steel treated with oil or detergent and subsequently annealed.

It is another object of the invention to provide a method for improving the corrosion-resistance of steel by reducing the carbonaceous residue of steel-treating compositions on the surface of annealed steel, thereby facilitating application of preservative coatings.

It is a further object of the invention to provide a method for improving the clean-burning characteristics of metal-treating compositions to substantially reduce the non-volatile carbonaceous thermal decomposition products thereof.

SUMMARY OF THE INVENTION

The invention comprises a method for reducing the residue of non-volatile carbonaceous thermal decomposition products of metal-treating compositions resulting from the high-temperature processing of a metal substrate treated with such compositions. The invention further comprises a method for improving the receptivity of steel to post-annealing coating compositions, and additionally comprises a method for improving the clean-burning characteristics of metal-treating compositions by reducing the adherent residue of thermal decomposition products thereof.

According to the method of the invention, metal-treating compositions for application to a metal substrate prior to heat treatment thereof are modified with certain acetylenic alcohols. Surprisingly, it has been found that such compositions have improved clean-burning characteristics and that metals treated with the modified compositions have an unexpectedly lower residue of thermal decomposition product after high temperature processing as compared to metals treated with the corresponding non-modified composition. Owing to the improved cleanliness of the metal surface after heat-treatment, conventional finishing treatments such as coating applications are facilitated. In particular, post-annealing phosphate treatment of steel is greatly improved as measured by increased corrosion resistance of the phosphated steel when the rolling oil or mill detergent applied to the steel prior to annealing contains an acetylenic alcohol according to the present invention.

DETAILED DESCRIPTION OF THE INVENTION

According to the present invention, an aliphatic monoacetylenic alcohol containing one or two hydroxyl groups is incorporated into a metal-treating composition prior to application of the composition to the substrate metal in an amount of about .01 to 10% of the composition. The metal is then heat-treated at temperatures above about 1200° F., preferably to about 1300° F., and a finish or prefinish coating applied to the heat-treated metal. Owing to the modification of the metal-treating composition with the acetylenic alcohol, the carbonaceous residue comprising the thermal decomposition product of the metal-treating composition is substantially reduced on the heat-treated metal, thus permitting the more effective adherence of finish coatings to the metal. In particular, it has been found that the corrosion-resistance of steel can be significantly improved if rolling oil or mill detergent customarily applied to the steel prior to batch annealing is modified with the monoacetylenic alcohols of the invention. The resultant decrease in carbonaceous residue formed during annealing comprises a reduction in the barrier to effective phosphating, and a surprising improvement in the effectiveness of the phosphate coating is thereby obtained.

The aliphatic acetylenic monoalcohols of the invention are in particular of the formula:

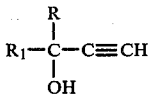

wherein

R is H or methyl; and $R_1$ is H or branched or unbranched $C_1$–$C_7$-alkyl; or R and $R_1$ together with the 3-carbon atom form cyclohexyl.

The aliphatic acetylenic diols of the invention are in particular of the formula:

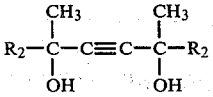

wherein $R_2$ is branched or unbranched $C_1$–$C_4$-alkyl.

The aliphatic acetylenic diols of the invention include ethoxylated diols of the formula

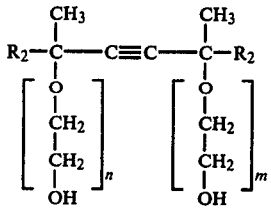

wherein $R_2$ is branched or unbranched $C_1$–$C_4$-alkyl, and m+n are from 3.5 to 40.

Preferred acetylenic alcohols useful for modifying the metal treating compositions of the inventions are selected from the group consisting of 1-ethynyl-1-cyclohexan-1-ol, 3-methyl-1-butyn-3-ol, 1-hexyn-3-ol, 1-propyn-3-ol, 3,5-dimethyl-1-hexyn-3ol, 3-methyl-1-pentyn-3-ol, 4-ethyl-1-octyn-3-ol, 2,4,7,9-tetramethyl-5-decyn-4,7-diol, 3,6-dimethyl-4-octyn-3,6-diol, and 2,5-dimethyl-3-hexyn-2,5-diol. Particularly preferred alcohols are 1-hexyn-3-ol, 3,6-dimethyl-4-octyn-3,6-diol, 4-ethyl-1-octyn-3-ol, and ethoxylated 2,4,7,9-tetramethyl-5-decyn-4,7-diol. The latter ethoxylated diols are available commercially as the 400 series of Surfynol compounds, and of these Surfynol 440, 465 and 485 are particularly useful for modifying mill detergents. These compounds are identified by structural formula as follows:

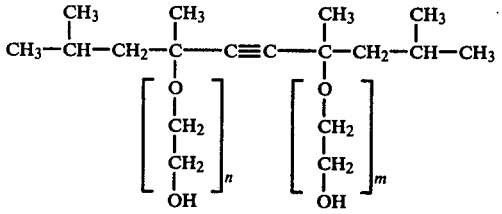

Surfynol 440: m+n=3.5 mols ethylene oxide

Surfynol 465: m+n=10 mols ethylene oxide

Surfynol 485: m+n=30 mols ethylene oxide

Particularly preferred acetylenic alcohols for modifying rolling oil are 1-hexyn-3-ol, 3,6-dimethyl-4-octyn-3,6-diol, and 4-ethyl-1-octyn-3-ol. Preferably, these compounds are incorporated in a conventional rolling oil in the amount of from about 1.0% to 5.0% by weight of oil.

The rolling oil and mill detergent are of any conventional composition. Suitable rolling oils inlcude compositions comprising mineral oils, animal fats such as tallow and typically ethoxylated emulsifiers, or equivalent ingredients. Suitable mill detergent compositions include water, non-ionic surfactants, and typically a corrosion inhibitor such as sodium nitrite. Other conventional ingredients include fatty amines or triethanol amine. In general, the rolling oils contemplated in the practice of the invention include known extreme pressure lubricants, while the mill detergents contemplated are those conventionally employed in steel milling operations.

The following Examples are provided to illustrate the invention:

ROLLING OIL EXAMPLES

EXAMPLE I

Four rolling oil compositions as follows were prepared by adding the ingredients in order at 150° F. with agitation until clear and homogeneous:

| | A | B | C | D |
|---|---|---|---|---|
| 200 sec Mineral Oil | Balance | Balance | Balance | Balance |
| Ethoxylated (6 mols) nonyl phenol | 4.0 | 4.0 | 4.0 | 4.0 |
| Tall Oil Fatty Acids | 3.0 | 3.0 | 3.0 | 3.0 |
| Morpholine | 0.5 | 0.5 | 0.5 | 0.5 |
| Yellow Grease | 42.5 | 42.5 | 42.5 | 42.5 |
| 1-hexyn-3-ol | 0.1 | 5.0 | 10.0 | — |
| Total | 100.0 | 100.0 | 100.0 | 100.0 |

All amounts are percent by weight of the composition. The control, composition D, is a typical semi-fatted rolling oil for a sheet mill.

Example II illustrates the preparation of steel test panels in the best mode known to me of practicing the invention.

EXAMPLE II

Each of the rolling oil compositions as prepared in Example I is emulsified in water at 10% by volume to provide an emulsion having a concentration which will yield an oil coating weight on steel approximately equal to that obtained under production conditions. Steel test panels are dipped in each 10% emulsion until thoroughly coated and then supported vertically on paper towels until the water has evaporated, leaving an oil coating on the steel. These prepared panels are then stacked and bolted between two steel plates after which they are stored overnight at 250° F. to simulate a tightly wound steel coil from a rolling mill.

To simulate batch annealing, this stack of panels is placed in an inert gas atmosphere retort furnace. The gas used is 95% nitrogen/5% hydrogen at a flow rate of 300 cc. per minute. The steel panels were annealed in this furnace at 1250° F. for 10 hours. After cooling, the panels were observed visually. It was found that the rolling oil containing 1-hexyn-3-ol (Compositions A, B and C) produced the least carbonaceous surface residue on the steel panels. Testing of the corrosion resistance is in Example III.

EXAMPLE III

The steel test panels which were annealed in Example II were spray-washed in a conventional alkaline cleaner. They were rinsed in tap water and a zinc phosphate coating of 200 milligrams per square foot applied, followed by a tap water rinse and a final chromate seal application. These panels were then spray painted with a white enamel. The painted panels were scribed diagonally to expose bare steel and placed in a neutral salt spray cabinet for 240 hours. The panels were then evaluated by measuring the under-corrosion from the scribed line in 1/32 inch increments. This measurement is commonly known as the creep. The results of these tests are given in Example IV.

EXAMPLE IV

The corresponding creep measurement for each of the three sets of steel panels is shown below:

| Pre-anneal oil coating used | Relative appearance after anneal | Salt Spray creep inches |
|---|---|---|
| Panels without oil | Free of deposit | No creep |
| Panels with oil containing no hexynol | Severe carbonaceous deposit | 7/32 inch |
| Panels with hexynol-containing oil | Slight carbonaceous deposit | 1/32 inch |

This illustrates a significant improvement in salt spray performance when 1-hexyn-3-ol is incorporated into the rolling oil formation.

EXAMPLE V

Four mill detergent compositions as follows were prepared by combining the ingredients at 100° F. with agitation until a clear, homogeneous solution is obtained:

| | A | B | C | D |
|---|---|---|---|---|
| Water | Balance | Balance | Balance | Balance |
| Octyl phenoxy polyethoxy ethanol | 10.0 | 10.0 | 10.0 | 10.0 |
| Sodium Nitrite (corrosion inhibitor) | 15.0 | 15.0 | 15.0 | 15.0 |
| Triethanolamine | 15.0 | 15.0 | 15.0 | 15.0 |
| Surfynol 465 | 0.1 | 5.0 | 10.0 | — |
| Total | 100.00 | 100.0 | 100.0 | 100.0 |

All amounts are in percent by weight of the composition The control, Composition D, is a typical mill detergent.

EXAMPLE VI

A solution of each of the above mill detergents is prepared at 5% by volume in water at 150° F. Steel test panels are immersed in each of the detergent composition solutions. Also included are steel panels without any mill detergent treatment. After immersion, the panels are supported vertically on paper towels to allow the water to evaporate, leaving a film of mill detergent. The test panels are then batch annealed in an inert gas retort furnace at 1250° F. for 10 hours at a gas flow rate of 300 cc. per minute. When cooled sufficiently, the test panels are evaluated visually for degree of carbonaceous residue.

| Panel Treatment | Carbonaceous residue apparent after anneal |
|---|---|
| None | No residue |
| Mill detergent with Surfynol 465 | Slight residue |
| Mill detergent without Surfynol 465 | Moderate residue |

The preceding Examples exemplify results typical of the present invention. As is well-known to those skilled in the art, however, the surface characteristics of steel vary widely from batch to batch, and the effectiveness of post-annealing phosphate treatment, for example, is to some degree dependent on these surface characteristics.

What is claimed is:

1. A method for reducing the residue of non-volatile carbonaceous thermal decomposition products of a metal-treating composition resulting from the high-temperature processing of a steel substrate treated with said composition, comprising (a) modifying said metal-treating composition by incorporating therein an aliphatic monoacetylenic alcohol containing one or two hydroxy groups in the amount of from about 0.1% to about 10% by weight of said metal-treating composition;

(b) treating the metal substrate with said modified composition; and (c) processing the treated metal at tempertures above about 1200° F. whereby the ensuing residue of thermal decomposition product is substantially less than would be the residue of the unmodified metal-treating composition.

2. The method of claim 1, wherein the aliphatic acetylenic alcohol is (a) a monoalcohol of the formula

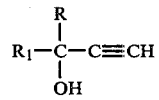

wherein

R is H or methyl; and $R_1$ is H or branched or unbranched $C_1$–$C_7$-alkyl; or R and $R_1$ together with the 3-carbon atom form cyclohexyl;

(b) a diol of the formula

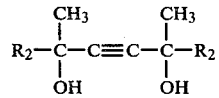

wherein $R_2$ is branched or unbranched $C_1$–$C_4$-alkyl; or (c) an ethoxylated diol of the formula

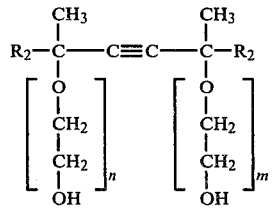

wherein $R_2$ is branched or unbranched $C_1$–$C_4$-alkyl and m+n are from 3.5 to 40.

3. The method of claim 2, wherein the aliphatic acetylenic alcohol is selected from the group consisting of 1-ethynyl-1-cyclohexan-1-ol, 3-methyl-1-butyn-3-ol, 1-hexyn-3-ol, 1-propyn-3-ol, 3,5-dimethyl-1-hexyn-3-ol, 3-methyl-1-pentyn-3-ol, 4-ethyl-1-octyn-3-ol, 2,4,7,9-tetramethyl-5-decyn-4,7-diol, 3,6-dimethyl-4-octyn-3,6-diol, 2,5-dimethyl-3-hexyn-2,5-diol and ethoxylated 2,4,7,9-tetramethyl-5-decyn-4,7-diol.

4. The method of claim 3, wherein the acetylenic alcohol is selected from the group consisting of 1-hexyn-3-ol, 3,6-dimethyl-4-octyn-3,6-diol, and 4-ethyl-1-octyn-3-ol and is incorporated in the amount of from 0.1% to 10% by weight of the rolling oil.

5. The method of claim 4, wherein the acetylenic alcohol is an ethoxylated 2,4,7,9-tetramethyl-5-decyn-4,7-diol.

6. The method of claim 5, wherein the 2,4,7,9-tetramethyl-5-decyn-4,7-diol contains 3.5, 10, or 30 mols of ethylene oxide per mol of diol, and $R_2$ is isobutyl.

7. The method of claim 1, wherein the acetylenic alcohol is 1-hexyn-3-ol.

8. The method of claim 1, wherein the metal is steel and is coated with a phosphate after high-temperature processing without interim cleaning prior to annealing.

* * * * *